US006578639B1

(12) United States Patent
Osime et al.

(10) Patent No.: US 6,578,639 B1
(45) Date of Patent: Jun. 17, 2003

(54) DISABLER AND STORAGE SYSTEM FOR HAZARDOUS SUBSTANCES

(76) Inventors: Joshua Oghenogieme Osime, P.O. Box 656, Alief, TX (US) 77411-0656; Blessing Akhesome Eshiemomoh, P.O. Box 1771, Bloomfield, NJ (US) 07003

( * ) Notice: Subject to any disclaimer, the term of this patent is extended or adjusted under 35 U.S.C. 154(b) by 0 days.

(21) Appl. No.: 09/653,833

(22) Filed: Sep. 1, 2000

(51) Int. Cl.[7] ..... A62C 13/40

(52) U.S. Cl. ..... 169/68; 169/66; 169/54; 169/7; 169/9; 169/13; 169/46

(58) Field of Search ..... 169/68, 66, 62, 169/54, 46, 9, 11, 13, 16, 7, 18

(56) References Cited

U.S. PATENT DOCUMENTS 2,692,649 A * 10/1954 McCreary ..... 169/68
2,706,527 A * 4/1955 Guljas et al. ..... 169/68
3,930,541 A 1/1976 Bowman et al.
4,925,057 A * 5/1990 Childress et al. ..... 169/66
5,314,027 A * 5/1994 Wood ..... 169/68
5,425,886 A * 6/1995 Smith ..... 169/66
5,573,068 A * 11/1996 Sharma et al. ..... 169/68
5,904,190 A 5/1999 Patel
5,934,379 A 8/1999 Østlyngen et al.
5,975,466 A 11/1999 Kahara et al.
6,012,533 A 1/2000 Cramer
6,145,599 A * 11/2000 Mumme ..... 169/66

* cited by examiner

*Primary Examiner*—Michael Mar
*Assistant Examiner*—Dinh Q. Nguyen

(57) ABSTRACT

This invention is geared at attacking the scourge of explosive fires, burns, environmental pollution, or other such hazards associated with the use, transport, and storage of fuels and other hazardous substances, before they occur, including the explosion hazard present in many automotive rear-end collisions. This is achieved by swiftly reacting a "disabler" or "neutralizer" with the hazardous substance, voluntarily or by automation, on the occurrence of predetermined events that position the hazardous substance to threaten a greater than desired risk of harm. According to one of the preferred embodiments of this invention, the formation of combustion vapors in the ullage of fuel tanks is altogether prevented.

15 Claims, 3 Drawing Sheets

DISABLER AND STORAGE SYSTEM FOR HAZARDOUS SUBSTANCES

CROSS-REFERENCE TO RELATED APPLICATION

Not Applicable

STATEMENT REGARDING FEDERALLY SPONSORED RESEARCH & DEVELOPMENT

Not Applicable

REFERENCE TO MICROFICHE APPENDIX

Not Applicable

BACKGROUND TO INVENTION

This invention relates to the fields of safety systems aimed at preventing, suppressing, or otherwise mitigating hazards associated with the use, storage or transportation of hazardous substances such as fossil fuels, acids, bases, bio-hazards and such like.

There have been some patents that seek to address the issue of prevention and/or fighting of some of the hazards aforementioned. U.S. Pat. No. 6,012,533 discloses a system of preventing and suppressing fires and explosions by displacing oxygen in the ullage space in fuel tanks with inert gas to a level that inhibits combustion in the fuel tank. U.S. Pat. No. 5,904,190 on the other hand discloses a method of preventing explosions in closed tanks by filling the ullage space with oxygen-excluding (and electronegative) gas. U.S. Pat. No. 5,934,379 discloses the use of $CO_2$ refrigerant in a vehicle air conditioning system (plus $N_2$ and argon) to fight/prevent fire in a vehicle upon occurrence of a collision.

The aforementioned patents however seek to address only the danger posed by combustible fuels and not other hazards. They also do not address the explosion hazard arising from the rupture of a vehicular fuel tank during a collision. U.S. Pat. No. 5,934,379 would provide little help where the fuel has seeped out of the tank and thus readily amenable to ignition, the occurrence of which may rapidly culminate in an explosion of the remaining fuel in the tank.

U.S. Pat. No. 3,930,541 discloses a device to rapidly suppress gasoline fuel fires which are started as a result of the rupture of a military vehicle fuel tank by amour-piercing projectiles. This device, by its spirit and terms, is actuated by enemy projectile (ostensibly in war conditions) penetrating panels with pressurized suppressants into the fuel tank. Its usefulness in civilian/peacetime scenarios is thus doubtful U.S. Pat. No. 5,975,466 discloses an improved variable displacement fuel tank for an aircraft. It however hardly addresses, nor is geared towards the safety concerns of this invention. It is moreover complex in application and inapplicable for deployment in the myriad of scenarios set out herein.

SUMMARY OF INVENTION

The Disabler and Storage System for Hazardous Substances ("the Disabler System") is a revolutionary system aimed at attacking the scourge of explosive fires or other such hazards before they occur. Many vehicular accidents, plane crashes, train collisions etc involving fossil fuel engines or the transportation of explosive or otherwise hazardous material have a heightened measure of danger because of the risk of fire, explosion, environmental pollution and such like. Thus in the event of such an accident, though the victims may survive the primary impact, the real threat (and usual occurrence thereof) of, say, an explosion, pales the fact of surviving the primary impact into oblivion.

It is an object of the invention to "incapacitate" or "disable" (alter to become non-combustive/non-explosive) the fuel in the fuel tanks of fossil fuel (or other type fuel) driven vehicles, at the same time as, split seconds after, or in some situations before, such a vehicle is involved in a mishap (or determined to be set on course for such) that places the fuel in danger of combusting outside the design of that system, whether within the tank, or through seepage, outside the tank.

It is another object of this invention to "neutralize" or "disable" (alter to eradicate power to cause undesirable effect) hazardous materials (fuels, solid, liquid and gaseus compounds or elements held in storage or being transported) where their storage or transportation system or facility is impacted such that their exists an unreasonably high possibility that the hazardous material may leak, explode, corrode, pollute, burn or otherwise extract an undersirable effect in that circumstance.

It is another object of this invention to "neutralize" or "disable" (alter to eradicate power to cause undesirable effect) hazardous materials (fuels, solid, liquid and gaseous compounds or elements held in storage or being transported) where their storage or transportation system or facility is impacted such that there exists an unreasonably high possibility that the hazardous material may leak, explode, corrode, pollute, burn or otherwise exact an undesirable effect in that circumstance.

It is yet another object of this invention, by one of its preferred embodiments, to eliminate the presence of (dangerous) flammable vapors in the ullage of tanks containing combustible fuels.

Further objects and advantages of this invention will become apparent from a consideration of the drawings and ensuing description.

The Disabler System is modifiable to be of relevance in an astounding and almost unbelievable range of applications. To name but a few, it is amenable to deployment in motorbikes, cars, trains, airplanes, fuel or hazardous materials transporters and storage facilities etc.

LIST OF REFERENCE NUMERALS

1=Rigid Wall Fuel Tank
2=Rigid Wall Fuel Tank 1 Inlet
3=Normal Fill Line
4=Fuel Tank 1 Normal Outlet
5=Disabler Tank
6=Perforated Pipe Irrigation Grid
7A=No-Return Valve Between the Disabler tank 5 and the Fuel Tank 1
7B=Fuel Tank 1 Outlet Shut-Off Valve
7C=No-Return Valve Between Fuel Tank 1 and Temporary Tank 14
8=Nozzle
9=Rigid Wall Fuel Tank 1/Flexible Bladder Tank 12 Extra Capacity or "Disabler Allowance"
10=Exterior Layout of Pipes Connected to Nozzles 8

11=Pipe Connecting Disabler Tank 5 to disabler dispersion means
12=Airtight Flexible Bladder
12A=Flexible Bladder Full Extension Position
12B=Depleted Flexible Bladder Position
13=Fuel pump
14=Temporary Tank
15=Temporary Tank 14 Inlet
16=Disabler Dispersion Stem

DESCRIPTION AND OPERATION OF THE INVENTION—MAIN EMBODIMENT

A "disabler" for our purposes is a substance that reacts with or interferes with a fuel or other combustible/corrosive or otherwise harmful chemical or substance (hereinafter collectively called "fuel") such that the latter's combustive/inflammatory/corrosive or otherwise less desirous properties are completely or substantially curtailed with the end-product(s) of such interference similarly harmless. An illustration of this concept is the acid/base reaction of hydrochloric acid (HCl) and sodium hydroxide (NaOH), wherein each of the reagents basically "annihilates" the other, each stripping the other of its corrosive or otherwise harmful properties, yielding an otherwise harmless salt and water solution.

Though a few suggestions are made hereunder, one does not purport to have identified all such efficient disablers yet. Thorough and extensive research needs to be made in this direction. In any case, the chemical composition of a particular system has to be examined to identify its most efficient disabler. However, greater emphasis at this point is on the revolutionary process and apparatus by which such would be put to use.

Figure 1:
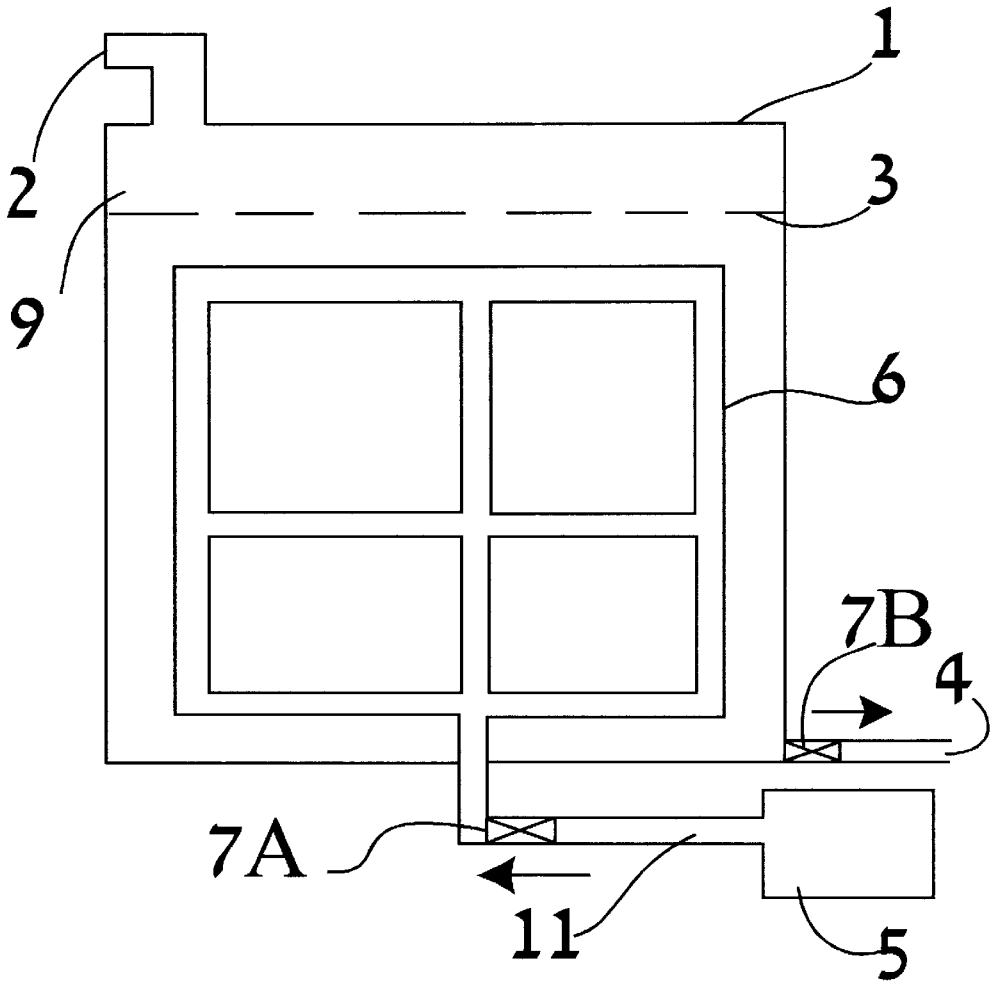
FIGS. 1, 2, and 3 disclose schematic cross-sectional views of three preferred embodiments of this invention as fitted to a rectangular shaped tank.

In a preferred embodiment of this invention, FIG. 1 discloses a cross-sectional view of a rectangular fuel tank 1 for (as an example) a motor vehicle. Fuel is poured into tank 1 at inlet 2. By means of a floating ball or other device, an electric circuit would indicate, e.g. by a flashing red light, at tank inlet 2 that the normal tank volume, as indicated by a normal fill line 3, has been attained. An extra tank capacity, or "diabler allowance" 9 is needed to accommodate upward volume changes that would occur when the disabler is deployed.

A network of non-corrodible and perforated pipes forming an "irrigation grid" 6, (through which the disabler is mixed with the fuel on deployment) is laid inside fuel tank 1 and connected to disabler tank 5. A one way, no-return valve 7A, situate at pipe 11 connecting disabler tank 5 to irrigation grid 6, prevents the fuel in tank 1 from exiting other than through an outlet 4 (e.g. to a carburetor) and flowing into disabler tank 5.

The disabler is stored in a disabler tank 5 under high pressure or otherwise connected to a pump (not shown) that can empty it into fuel tank 1 in times ranging from split seconds to a few seconds in the critical seconds after the occurrence of a "trigger" event. A shut-off valve 7B is also simultaneously activated to cut off further fuel supply through outlet 4.

Sensors, (not shown) detect the occurrence of "trigger events," which events vary depending on the Disabler System's particular application. A trigger event is that event that would place the fuel in fuel tank 1 in danger of combusting (or otherwise acting out its properties) outside the design of that system. For a car involved in, say, a collision, the secondary risk of explosion/fire is a deadly and real risk. In such a case, the Disabler System should be linked to the circuitry that deploys say, the airbags and be activated at the same time. Special and separate circuitry may be required however for the Disabler System as some deadly collisions like rear-ending may go unnoticed by the (more) frontal/side impact oriented airbag circuitry.

For an airplane, trigger events may be certain thresholds of rapid and continuous altitude loss, (symptomatic of severe power loss and inevitable plane crash). The Disabler System may even be deployed voluntarily by a pilot, who finds himself set for a definite crash course, to minimize a post crash fire/explosion hazard.

Sensors detect the commencement of a loaded fuel tanker's rollover, a train (fuel tanker or fuel driven) derailment, a motorbike collision, fall etc and thus deploy the Disabler System to arrest/minimize imminent fire/explosion hazard. The applicable scenarios are endless.

DESCRIPTION AND OPERATION—ALTERNATIVE EMBODIMENTS

Figure 2:
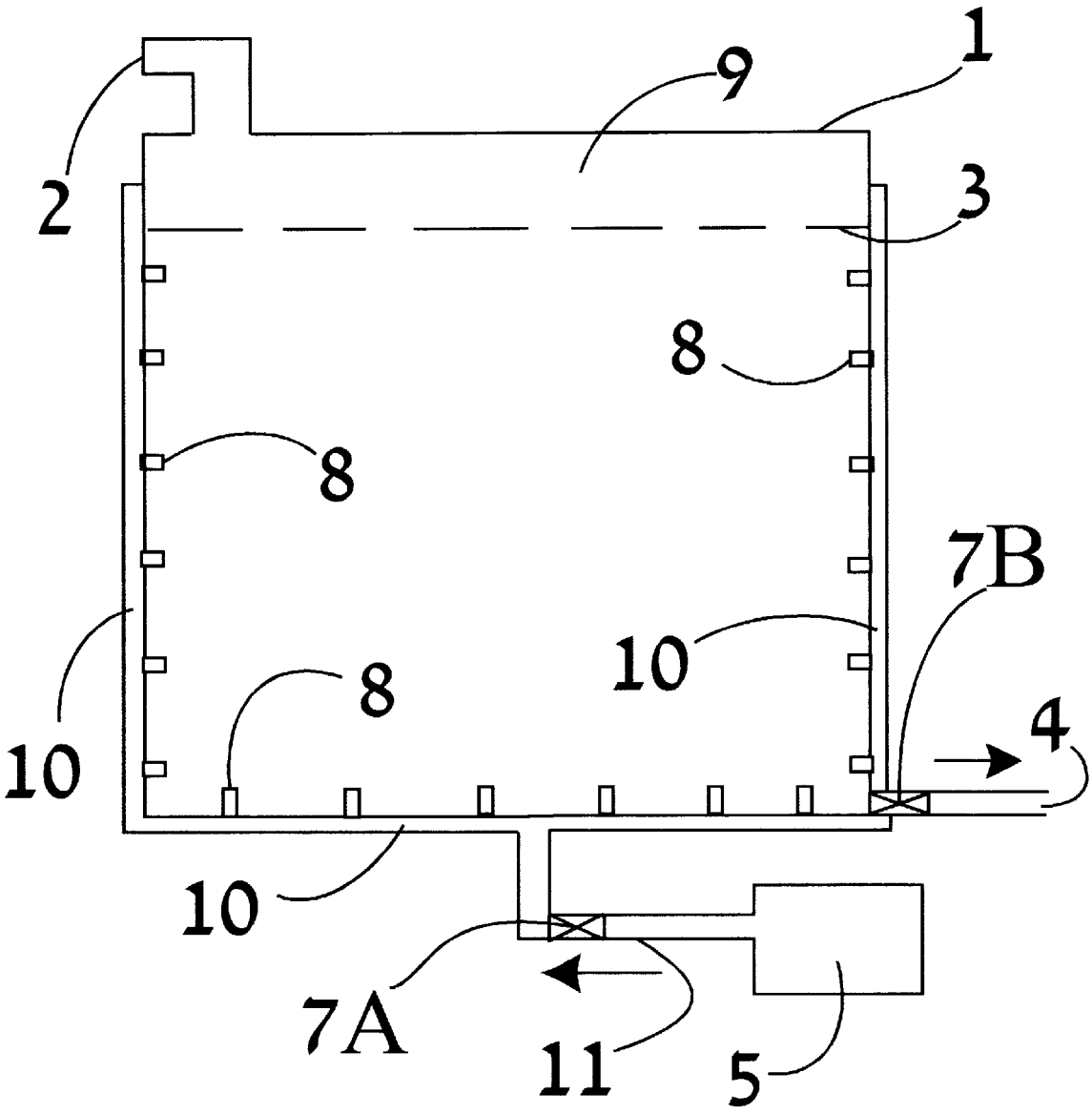

FIG. 2 discloses another preferred embodiment of this invention. It shows a cross-sectional view of a rectangular fuel tank 1 similar in all operational respects to the first preferred embodiment of this invention set out above. Its design however varies in this respect. Instead of internal irrigation grid 6, there is an exterior layout of pipes 10 around fuel tank 1 connected to a number of nozzles 8 penetrating the tank wall such as to be able to inject the disabler into the fuel in the tank. These nozzles are all equipped with one way no-return valves (not shown) that ensure that the disabler will only flow into fuel tank 1 at deployment and that no fuel therein will exit other than through outlet 4 and flow backwards into disabler tank 5. The exterior pipe layout 10 is supplied with the disabler via pipe 11.

Figure 3:
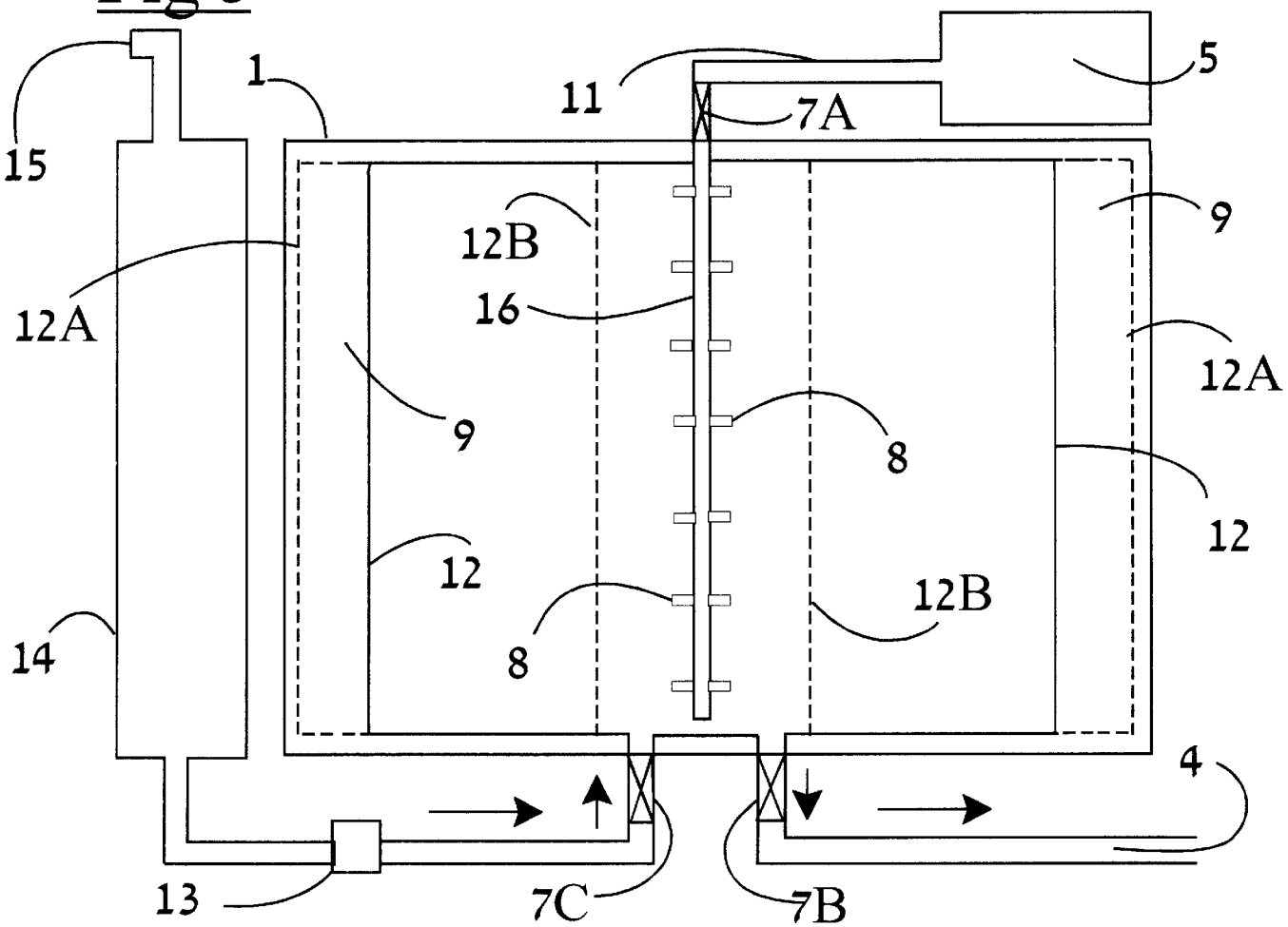

FIG. 3 discloses yet another preferred embodiment of this invention. In general its operation is similar to the two other preferred embodiments set out above. It progresses further however with its unique and revolutionary fuel storage bladder designed to eliminate the presence of flammable vapors in the ullage of tanks containing combustible fuels.

There is disclosed in this embodiment an airtight flexible bladder 12 set within an airtight rigid tank 1. The bladder is made from materials determined to resist dissolution by or otherwise reacting with the fuel it contains. Through an inlet 15, a smaller temporary tank 14 is filled with fuel. By use of an automated or manually operated control panel (not shown) situated, say, near inlet 15, a fuel pump 13 is activated to empty temporary tank 14 into flexible bladder 12. A one way, no-return valve 7C ensures no backward flow of fuel into temporary tank 14. The procedure of filling temporary tank 14 and emptying it into flexible bladder 12 is repeated and monitored at the control panel until the full bladder position, indicated as the bladder 12 outline, is attained. Although flexible bladder 12 is extendable to the position 12A, the volume difference (indicated as a "disabler allowance" 9) between this and the "full" position 12, is necessary to accommodate volume changes when the disabler is deployed.

Temporary tank 14 and fuel pump 13 can be done away with if facilities (for example, where this disabler system is setup in an automobile, facilities other than the regular automobile filing station type nozzles) exist for pressure filing the bladder at valve 7C without compromising its "airtightness". Such pressure filing procedure contemplated here is similar to the procedure for filing pneumatic tires.

As the fuel in flexible bladder 12 is suctioned off in normal use through outlet 4, the bladder, being airtight, shrinks to the volume of its remaining contents, thus preventing the formation of flammable vapors, that otherwise may form in the ullage of a rigid-walled tank. The flexible bladder 12 position indicated as 12B discloses a bladder position wherein its contents are depleted.

As with the other preferred embodiments set out above, at the occurrence of a "trigger" event, the disabler in disabler tank 5 is rapidly emptied, by means such as pressurized storage or a high speed pump (not shown), into flexible bladder 12, while a shut-off-valve 7B simultaneously activates to deny further fuel supply through outlet 4.

The disabler is supplied via pipe 11 to a dispersion stem 16, which extends into the middle of flexible bladder 12 and to which are attached a set of nozzles 8. The nozzles are all equipped with one way, no-return valves (not shown) that deny the back flow of the fuel into disabler tank 5. A valve 7A at the beginning of dispersion stem 16 is set up to open only on the activation of the disabler system to allow disabler flow from tank 5 into flexible bladder 12. As in the other embodiments, when the system is not activated, valve 7A prevents inadvertent suction of the disabler into bladder 12/fuel tank 1 in a scenario where the fuel in the latter has been exhausted by normal use.

Our suggestions for some disablers worthy of further investigation and research, for use in fossil fuel (e.g. gasoline) systems, are 1. alkaline elements/compounds—for their saponifying effect on hydrocarbons (which most fossil fuels are).
2. detergents—for their ability to break down hydrocarbons.

While one believes both suggested disablers, of adequate type and concentration can chemically alter a fossil fuel like gasoline, kerosene, or diesel, such that its inflammability is tremendously hindered/eliminated, one would not wish to be bound by this.

The disablers for this invention could be gaseous, liquid, or solid. Gaseous disablers may have the added advantage of being lightweight and amenable to compression, thus alleviating increased vehicle weight concerns and facilitating faster delivery during a trigger event.

CONCLUSION, RAMIFICATION AND SCOPE

It will be seen by the reader that the Disabler and Storage System for Hazardous Substances set out above is of an astounding range of applications, and operates in all scenarios to save lives, equipment, and/or protect the environment from pollution, contamination and other harm.

Some of its advantages, apparent from the following few applications are (1) where setup in an automobile, the post-collision hazard (for example in rear endings) of fuel tank explosion is minimized/eradicated altogether.

(2) where set up in a fuel, acid, or other hazardous material transporter—trucks, trains, ships etc—the threat of explosion, corrosion or burning caused by the hazardous material in the event of a train derailment, truck rollover or collision, or ship mishap is minimized/eliminated by the activation (voluntary or by automation) of the disabler system.

(3) in an aircraft set for a crash-landing course, due to, say, sudden engine or other mechanical or electrical failure, the disabler system sensors will detect such predetermined factors and instigate the disabling process, at the most appropriate time, to minimize/eradicate post-crash explosion/fire hazards.

(4) where set up in a bio-hazard transporter (such as wastes from septic tanks, hospital wastes etc, a germicide or other appropriate disabler would insure minimal/no environmental pollution in the event of the waste container being compromised (5) in a facility for storing hazardous substances, whether explosive, corrosive, contaminatory, or otherwise hazardous, sensors will instigate the disabling process on the detection of such trigger events as unacceptable temperature increases, occurrence of fires dangerously close to the storage tank as to unavoidably spread thereto, and the occurrence of events capable of breaching the structural integrity of the storage tank including certain thresholds of earthquake readings.

(6) where the unique and revolutionary storage system is used, the volatile vapors in the ullage of tanks containing combustible fuels (for example automobile fuel tanks, tanker trucks) which vapors may initiate or amplify a fuel tank explosion, are altogether eliminated as the ullage space conducive to their formation is itself rendered extinct.

It will be seen from the foregoing that the dangers presented are sought to be prevented instead of being fought after they blossom, thus saving lives, valuable equipment, funds as well as safeguarding the environment.

Notwithstanding the illustrations and descriptions aforestated however, it is intended that the scope of this invention be no way limited. The preferred embodiments have been set forth as illustration only and any alteration, modification, combination or such like, within the spirit of the invention, are desired to be protected. For example, the dispersion stem 16 of the third preferred embodiment herein may be replaced with either of the irrigation grid 6 and nozzle system 8 respectively of embodiments one and two, or vice versa. Also, the shapes of the hazardous material and disabler tank may, instead of being rectangular be made tubular, spherical, conical etc, or otherwise formed to fit the ergonomical/aesthetic needs of each specific application.

What is claimed is:

1. A process of stripping an inflammable or hazardous material of its inflammability or hazardous abilities when one or more trigger events occur including a vehicular crash or collision, comprising the steps of (a) providing a container or tank for said inflammable or hazardous material, said container or tank being expansible for providing sufficient extra capacity to accommodate volume changes when a disabler is emptied into it;

(b) providing a container or tank for said disabler predetermined to be able to interact chemically and interfere with and alter said inflammable or hazardous material such that the latter is substantially and appreciably stripped of its inflammability or hazardous abilities;

(c) providing a means of speedily transporting said disabler from its container or tank into said container or tank of said inflammable or hazardous material including use of pumps and pressurized storage;

(d) providing a means of rapidly interacting said disabler with said inflammable or hazardous material;

(e) providing at least manual or automated means of identifying the occurrence of said trigger events; and whereby said inflammable or hazardous material, whether within or without its tank, is disabled and substantially and appreciably stripped of its inflammability or hazardous abilities, which abilities are otherwise manifestable on the occurrence of said trigger events.

2. A process according to claim 1 for forestalling dangers arising from a system's or apparatus' involvement with said inflammable or hazardous material in ways including use, storage, transportation, and production, on the occurrence of certain predetermined events, including the steps of (a) providing the system or apparatus with said tank containing said disabler identified to be able to disable said inflammable or hazardous material of the system or apparatus, said disabler tank being fluidly connected to said inflammable or hazardous material tank, with valves ensuring flow only from the former to the latter, and such flow occurring only during the activation of the disabling process;

(b) instigating the disabler/inflammable or hazardous material interaction voluntarily or by automation on the occurrence of said trigger events including certain vehicular collisions, aircraft crashes, undesirable temperature changes in hazardous material storage tank and a motorcycle fall; and whereby system's or apparatus' said inflammable or hazardous material's ability to inflame, corrode, explode, pollute or otherwise exact an undesirable effect is restrained.

3. A process of claim 1 further including a method of eliminating the ability of said inflammable or hazardous material to form volatile and hazardous vapors in its containing tank comprising (a) providing an airtight flexible bladder determined to be capable of inertly holding said inflammable or hazardous material;

(b) providing a means of structurally supporting and protecting said bladder including setting same inside another protective tank;

(c) providing a means of filling said flexible bladder without compromising its airtightness;

(d) providing a means of suctioning off said inflammable or hazardous material from the said flexible bladder when required; and whereby said flexible bladder, being airtight, maintains the volume of its remaining contents, eliminating the ullage space and thus preventing the formation of said volatile vapors.

4. An apparatus for practicing the process of claim 3 whereby volatile vapors are eliminated from the ullage of tanks comprising (a) an airtight flexible bladder determined to be capable of inertly holding the said volatile vapors forming inflammable or hazardous material;

(b) means of structurally supporting and protecting said bladder including setting same inside another protective tank;

(c) means of filling said flexible bladder without compromising its airtightness, including use of a temporary tank fluidly one-way connected to said airtight flexible bladder, said temporary tank being filled and drained into said flexible bladder until a preset volume is attained, without compromising its airtightness;

(d) means of suctioning off said inflammable or hazardous material from the said flexible bladder when required; and whereby said bladder extends and contracts only to the extent of its contents thus eliminating any ullage space conducive to volatile vapor formation.

5. An apparatus for stripping an inflammable or hazardous material of its inflammability or hazardous abilities when one or more trigger events occur, including a vehicular crash or collision, comprising (a) a tank for said inflammable or hazardous material being expansible for providing sufficient extra capacity to accommodate volume changes when a disabler is emptied into it;

(b) a tank for said disabler predetermined to be able to chemically interact and interfere with and alter said inflammable or hazardous material such that the latter is substantially and appreciably stripped of its inflammability or hazardous abilities;

(c) fluid one-way connections from said disabler tank to said inflammable or hazardous material tank;

(d) means of and sensors for detecting the occurrence of said trigger events;

(e) means of rapidly emptying the disabler tank into said inflammable or hazardous material tank on the occurrence of said trigger events;

(f) means of rapidly interacting said disabler with said inflammable or hazardous material; and whereby said inflammable or hazardous material is disabled and substantially and appreciably stripped of its inflammability or hazardous abilities, which abilities are otherwise manifestable on the occurrence of said trigger events.

6. A vessel wherein is set up the apparatus of claim 5 and providing said tank for said inflammable or hazardous material being utilized for the needs of said vessel or carried as a transported commodity, said tank having sufficient extra capacity to accommodate volume changes when said disabler is emptied into it.

7. An apparatus of claim 5 wherein said inflammable or hazardous material includes a hydrocarbon and the disabler comprises joint and several use of (a) a saponifying agent (b) a soap (c) a detergent.

8. An apparatus of claim 5 wherein said inflammable or hazardous material includes germs and the disabler includes an appropriate germicide, whereby dangers posed to the health and safety of people, animals and the environment by such hazards are curtailed.

9. An apparatus according to claim 5 wherein said disabler is rapidly interacted with said inflammable or hazardous material by means of a perforated pipe grid connected to the disabler tank and laid inside said inflammable or hazardous material tank.

10. An apparatus according to claim 5 wherein said disabler is rapidly interacted with said inflammable or hazardous material by means of at least one strategically placed nozzle with one-way valve, connected to the disabler tank and extending through said inflammable or hazardous material tank wall.

11. An apparatus of claim 5 further including means for eliminating the volatile vapors in the ullage space of rigid wall tanks containing certain vapor-forming inflammable or hazardous material comprising (a) an airtight flexible bladder, substituting said tank for said inflammable or hazardous material, and determined to be capable of inertly holding the said inflammable or hazardous material, said bladder having sufficient extra capacity to accommodate volume changes when a disabler is emptied into it;

(b) means of structurally supporting and protecting said bladder including setting same inside another protective tank;

(c) means of filling said flexible bladder without compromising its airtightness, including use of a temporary tank fluidly one-way connected to said airtight flexible bladder, said temporary tank being filled and drained into said flexible bladder until a preset volume is attained, without compromising its airtightness;

(d) means of suctioning off the said inflammable or hazardous material from the said flexible bladder when required; and whereby said bladder extends and contracts only to the extent of its contents thus eliminating any ullage space conducive to volatile vapor formation.

12. A vessel wherein is set up the apparatus of claim 11 and providing said airtight flexible bladder holding said inflammable or hazardous material being utilized by said vessel or carried as a transported commodity.

13. An apparatus of claim 11 wherein said disabler is rapidly interacted with said inflammable or hazardous material by means of at least one strategically placed dispersion stem extending substantially into said flexible bladder, said dispersion stem having nozzle buds also strategically placed to maximize said interaction.

14. An apparatus of claim 11 wherein said inflammable or hazardous material includes a hydrocarbon and said disabler comprises joint and several use of (a) a saponifying agent (b) a soap (c) a detergent.

15. An apparatus of claim 11 wherein said inflammable or hazardous material includes germs and the said disabler includes an appropriate germicide, whereby dangers posed to the health and safety of people, animals and the environment by such hazards are curtailed.

* * * * *